US010136691B2

(12) United States Patent
Degolier et al.

(10) Patent No.: US 10,136,691 B2
(45) Date of Patent: Nov. 27, 2018

(54) HELMET LINER

(71) Applicant: Design Blue Limited, Croydon (GB)

(72) Inventors: Eric Degolier, Croydon (GB); Adam Turvey, Croydon (GB); Alkis Kiraolis, Croydon (GB)

(73) Assignee: DESIGN BLUE LIMITED, Croydon (GB)

( * ) Notice: Subject to any disclaimer, the term of this patent is extended or adjusted under 35 U.S.C. 154(b) by 126 days.

(21) Appl. No.: 14/912,824

(22) PCT Filed: Sep. 9, 2014

(86) PCT No.: PCT/GB2014/052726
§ 371 (c)(1),
(2) Date: Feb. 18, 2016

(87) PCT Pub. No.: WO2015/033171
PCT Pub. Date: Mar. 12, 2015

(65) Prior Publication Data

US 2016/0206034 A1 Jul. 21, 2016

(30) Foreign Application Priority Data

Sep. 9, 2013 (GB) ..... 1316036.1

(51) Int. Cl.
*A42B 3/00* (2006.01)
*A42B 3/12* (2006.01)
(Continued)

(52) U.S. Cl.
CPC ..... *A42B 3/12* (2013.01); *A42B 3/00* (2013.01); *A42B 3/105* (2013.01); *A42B 3/127* (2013.01); *A63B 71/10* (2013.01)

(58) Field of Classification Search
CPC .. A42B 3/127; A42B 3/14; A42B 3/00; A42B 3/122; A63B 71/10
See application file for complete search history.

(56) References Cited

U.S. PATENT DOCUMENTS 3,882,547 A 5/1975 Morgan
4,023,213 A 5/1977 Rovani
(Continued)

FOREIGN PATENT DOCUMENTS

JP 2007254920 10/2007
WO 2003/055339 1/2003
(Continued)

OTHER PUBLICATIONS

International Search Report dated Dec. 12, 2014.
United Kingdom Search Report dated Oct. 13, 2014.

*Primary Examiner* — Tejash Patel
(74) *Attorney, Agent, or Firm* — Ryan T. Grace; Advent, LLP

(57) ABSTRACT

A helmet liner adapted to be conformed to an inner surface of a helmet to cushion in use the rear of a wearers head from the helmet is described. The liner comprises a plurality of elongate grooves comprising at least one longitudinal groove configured to extend in use along a longitudinal direction between the nape of a wearers neck and the crown of the wearers head, and at least one lateral groove adapted to extend in use at least partially around the head of the wearer in a lateral direction between the wearers ears. The at least one longitudinal groove is deeper than the at least one lateral groove.

14 Claims, 3 Drawing Sheets

(51) Int. Cl.
*A42B 3/10* (2006.01)
*A63B 71/10* (2006.01)

(56) References Cited

U.S. PATENT DOCUMENTS

| | | | | |
|---|---|---|---|---|
| 4,354,284 | A | 10/1982 | Gooding | |
| 4,766,614 | A | 8/1988 | Cantwell et al. | |
| 5,035,009 | A | 7/1991 | Wingo, Jr. et al. | |
| 5,477,558 | A | 12/1995 | Voelker | |
| 8,205,272 | B2 * | 6/2012 | Green | A42C 5/02 2/209.13 |
| 8,291,520 | B2 * | 10/2012 | Lukens | A63B 71/10 2/209 |
| 2007/0192943 | A1 | 8/2007 | McDuff | |

FOREIGN PATENT DOCUMENTS

| | | |
|---|---|---|
| WO | 2005/000966 | 1/2005 |
| WO | 2012148582 | 11/2012 |

* cited by examiner

Section C-C lateral direction
longitudinal direction
head
12
12'
14
14'
16
16'
18
18'
10
10'
22
A
B
C Section A-A Section B-B

HELMET LINER

The present disclosure relates to impact protection apparatus, and more particularly to head gear such as helmets, and to liners and inserts for helmets.

Helmets are used in a variety of sporting, industrial and military environments. For instance, helmets are routinely used in a number of different sports, such as American football, ice hockey, field hockey, lacrosse, baseball, cycling, motorsports, downhill skiing and snowboarding, where there is a risk of traumatic brain injury due to impacts to the head.

Traumatic brain injuries occur when sudden acceleration or deceleration of the head causes linear, rotational or angular movement of the brain within the skull, leading to damage to brain cells, blood vessels and protective tissues. Symptoms of mild traumatic brain injury (concussion) typically include loss of consciousness, headache, nausea, dizziness, drowsiness and temporary cognitive impairment. More severe traumatic brain injuries can lead to permanent cognitive impairment, behavioural and emotional changes, and an increased risk of stroke and degenerative brain disorders. In particular, chronic traumatic encephalopathy (CTE) is a progressive neurodegenerative disease that is found mainly in professional athletes with a history of multiple concussions, and that causes depression and suicidality, cognitive dysfunction and aggression.

Studies have shown that the G-force threshold for concussions is generally about 70 to 85 G, although it will be appreciated that this highly dependent on the individual in question, and the type of impact. Impacts in sports such as American football tend to range from 20 to 180 G, and even as high as 200 G. By way of reference, a pilot in a jet fighter generally has to withstand a maximum of 4.5 G and a car crash at 25 miles per hour tends to create about 100 G.

The risk of traumatic brain injuries is a particular concern in full-contact sports, such as American football, ice hockey or lacrosse, in which athletes collide with each other and the ground with great force within the rules of the sport. It is estimated that professional American football players may receive as many as 1,500 blows to the head during a single season, and 15,000 over a 10 year playing career, depending on their position. Numerous cases of CTE have been diagnosed post-mortem in former professional American football players, often following suicide. Even high-school American football players have been found to receive around 650 impacts to the head each season, and at least 50 high school or younger athletes are reported to have died from head injuries on the field of play between 1997 and 2007 in the US alone.

Given that the average weight of a player in the NFL has grown by at least 10 percent since the 1980's to about 248 pounds, there are clearly many potential instances where concussion can arise. Further, the heaviest position, offensive tackle, has gone from about 280 pounds two decades ago to about 320 pounds in today's game.

Typically helmets comprise rigid structures adapted to reduce the pressure associated with an impact by increasing the cross section over which the force of the impact is distributed. In addition compressible materials, such as foams, may be used to line helmets. These act to reduce the acceleration experienced by the head as a result of an impact. For example, compression of a helmet liner may absorb some energy that would otherwise be transmitted to the head of a wearer.

It may be preferred for parts of a helmet to be replaced after a period of use, for example if a helmet is worn during an impact, part or all of the helmet can be replaced to ensure that the protection offered by the helmet is not reduced. In situations, such as those described above, it may be necessary to replace a large number of helmets and/or helmet components. Due to their irregular shape, and rigidity helmets are cumbersome and somewhat bulky, and storing and transporting large numbers of helmets represents a significant challenge.

The deformation characteristics of a helmet liner may be modified by the compressive or tensile stresses under which it is placed in order to conform it to a helmet. In addition, the thickness of the material may modify its capacity to reduce the acceleration associated with an impact.

The manner in which a helmet liner deforms in response to an impact may affect the nature of the force that is transmitted to the head of a wearer. For example, if the helmet liner is compressed radially against the shell of a helmet, it may tend to expand or spread in a direction parallel to the helmet shell. If the ability of the helmet liner to expand in this way is constrained, then the energy absorbing characteristics of the liner may be modified.

The present disclosure aims to provide helmet liners which can be stored flat to reduce the space required for storage, and then conformed to an interior surface of a helmet whilst offering improved impact protection characteristics.

In a first aspect, the present disclosure relates to a helmet liner adapted to be conformed to an inner surface of a helmet to cushion in use the rear of a wearer's head from the helmet, the liner comprising a plurality of elongate grooves comprising: at least one longitudinal groove configured to extend in use along a longitudinal direction between the nape of a wearer's neck and the crown of the wearer's head; and at least one lateral groove adapted to extend in use at least partially around the head of the wearer in a lateral direction between the wearer's ears; wherein the at least one longitudinal groove is deeper than the at least one lateral groove.

In one embodiment of the present disclosure, the grooves define pillars, coupled together by a base adapted to lie toward the helmet so that the pillars extend in use from the base towards the head of a wearer, wherein each pillar is tapered from the base in towards an end, carrying an end surface adapted to face the head of the wearer, and the tapering of the pillars is selected according to the curvature of the helmet so that when the base is conformed to the helmet, the end of each pillar is not pressed against an adjacent pillar.

The pillars described above may extend from the base so the spacing of the end surface from the base is greater than at least one of the lateral and longitudinal extent of the pillar. The pillars may have end surfaces comprising recesses. Advantageously, the presence of pillars allows a degree of rotational movement of the helmet upon impact.

Meanwhile, the spacing between the pillars may be selected based on the curvature of the helmet and the length of the pillars so that when the base is conformed to the helmet, voids remain between the pillars. Additionally, the spacing between the pillars may also be selected based on the area of the end surfaces so that when the base is conformed to the helmet, the end surfaces of the pillars present a continuous support surface to the head of the wearer in use. The continuous support surface may comprise at least one gap to permit air to flow from the surface into at least one of the voids between the pillars.

At least one of the voids mentioned above may be prism shaped and comprise at least one trapezoidal face. Preferably, at least one of the voids may be frustum shaped.

The voids defined by the pillars in accordance with embodiments of the present disclosure are advantageous in that they improve the impact resistance of the helmet liner in use since the helmet liner material may be displaced into the voids on impact as the material undergoes deformation.

In a further embodiment of the present disclosure, the liner is adapted to relax into a flat planar configuration and the liner comprises at least two wings adapted to extend in the plane of the flat planar configuration when the liner is relaxed, and to extend in use laterally around the sides of the head of a wearer towards the wearer's ears when the base is conformed to the helmet.

The lateral extent of each of the at least two wings may be greater than its longitudinal extent. The at least two wings may be coupled to extend laterally from a body portion, and the longitudinal extent of each wing may be greater towards portions of the wing that are laterally separated from the body portion.

In a further aspect, the present disclosure relates to a helmet liner comprising a plurality of pillars, coupled together by a flexible base adapted to be conformed to an inner surface of a helmet so the base lies toward the helmet and the pillars extend in use from the base towards the head of a wearer, wherein each pillar is tapered from the base in towards an end, carrying an end surface adapted to face the head of the wearer, wherein the pillars extend from the base so the spacing of the end surface from the base is greater than at least one of the lateral and longitudinal extent of the pillar and the spacing between the pillars is selected based on the curvature of the helmet and the length of the pillars so that when the base is conformed to the helmet frustum shaped voids remain between the pillars.

In one embodiment of the above further aspect of the disclosure, the frustum shaped voids may comprise: at least one longitudinal groove configured to extend in use along a longitudinal direction between the nape of a wearer's neck and the crown of the wearer's head; and at least one lateral groove adapted to extend in use at least partially around the head of the wearer in a lateral direction between the wearer's ears; wherein the at least one longitudinal groove is deeper than the at least one lateral groove.

In a further embodiment, the base maybe adapted to relax into a flat planar configuration.

In a yet further embodiment, the base may comprise a body portion, and at least two wings, adapted to extend laterally from the body portion in the plane of the flat planar configuration when the base is relaxed. Preferably, the base may additionally comprise at least two legs coupled to the body, wherein the legs are shorter than the wings and are adapted to extend laterally from the body in the plane of the flat planar configuration when the base is relaxed.

The present disclosure also provides a kit comprising a plurality of helmet liners, each helmet liner comprising at least two wings as described hereinbefore, stacked together so that the bases are parallel.

The present disclosure also provides a helmet comprising a liner as described hereinbefore. Preferably, the helmet is an American football helmet.

The helmet liner of the present disclosure may be made of any suitable energy absorbent material which is useful for absorption of energy from an impact, of which the person of skill in the art is readily aware.

Suitable materials include elastic materials such as polymeric foam materials. Examples of suitable polymeric foams include phenolic resin foams, polystyrene foams, polyurethane foams, polyethylene foams, polyvinylchloride foams, polyvinyl-acetate foams, polyester foams, polyether foams, and foam rubber.

Another group of materials suitable for use in connection with the helmet liner of the present disclosure corresponds to rate-sensitive materials. In the present disclosure, a rate-sensitive material is defined as a non-newtonian material (i.e. having a non-newtonian stress-strain profile) that exhibits a resistive load under deformation which increases with the rate of deformation. Rate-sensitive materials, which include shear thickening and dilatant materials, are capable of decelerating impact associated energies. Suitable rate-sensitive materials for use with the helmet liner of the present disclosure include rate-sensitive polyurethane foams, preferably microcellular open-cell polyurethane foams, for example those available from Rogers Corporation under the brand names PORON® and PORON XRD®.

In an embodiment, the helmet liner of the disclosure is formed from a rate-sensitive material which comprises a dilatant. More preferably, the rate-sensitive material is formed of a composite material comprising i) a first polymer-based material and ii) a second polymer-based material, different from i), which exhibits dilatancy in the absence of i), wherein the second polymer-based material ii) is entrapped in a matrix of the first polymer-based material i), the composite material being unfoamed or foamed, and, when unfoamed being preparable by incorporating the second polymer-based material ii) with the first polymer-based material i) prior to formation of the matrix, and when foamed, being preparable by incorporating the second polymer-based material ii) with the first polymer-based material i) prior to foaming. Preferably, the matrix of the first polymer-based material i) is a solid matrix, i.e. a matrix material which retains its own boundaries without need of a container.

The composite material may be suitable for use in the helmet liner of the present disclosure without foaming, i.e. it may be unfoamed as such, or it may be produced as a precursor to a composite material which is subsequently to be foamed, i.e. that is foamed after the second polymer-based material ii) has become entrapped in a matrix of the first polymer-based material i).

Preferably, the first polymer-based material i) and second polymer-based material ii) are in intimate admixture; for example, as attainable by blending i) and ii) together. By blending is meant herein the mixing together of polymer-based material i) and polymer-based material ii) in the semi-molten or molten state to form a composite material wherein the first polymer-based material i) and the second polymer-based material ii) are in intimate admixture. Where the composite material is unfoamed, the first polymer-based material i) and the second polymer-based material ii) are mixed prior to formation of the matrix. Similarly, where the composite material is foamed, the first polymer-based material i) and the second polymer-based material ii) are mixed prior to foaming. Thus, in each case, the second-polymer based material ii) is distributed within the body of a matrix/foam formed from the first polymer-based material ii) in the finished composite material.

The first polymer-based material i) may be one wherein the polymer comprising the first polymer-based material i) comprises ethylene-vinyl acetate (EVA), or an olefin polymer, for example polypropylene, or an ethylene polymer, such as high pressure polyethylene (LDPE), LLDPE or HDPE.

Preferably, the polymer comprising the first polymer-based material i) comprises an elastomer. While natural elastomers, e.g. latex rubbers, may be used, synthetic elastomers (such as neoprene), more preferably synthetic thermoplastic elastomers, such as thermoplastic polyesters, are preferred. Preferred classes of such elastomers include elastomeric polyurethanes and elastomeric EVAs (ethylene/vinyl acetate copolymers), and others, such as silicone rubbers, polyurethanes and EP rubbers, e.g. EPDM rubbers, may be suitable.

Any polymer-based material, different from i), which exhibits dilatancy and can be incorporated into the chosen elastic constituent(s) of first polymer-based material i) may be used as second polymer-based material ii). By a polymer-based material which exhibits dilatancy is meant a material in which the dilatancy is provided by one or more polymers alone or by a combination of one or more polymers together with one or more other components, e.g. finally divided particulate material, viscous fluid, plasticiser, extender or mixtures thereof, and wherein the polymer is the principle component. In one preferred embodiment, the polymer comprising the second polymer-based material ii) is selected from silicone polymers exhibiting dilatant properties. The silicone-based polymer is preferably selected from borated siloxane polymers. For example, the dilatant may be selected from filled or unfilled polyborodimethylsiloxanes (PBDMSs) or any number of polymers where PBDMS is a constituent. The dilatancy may be enhanced by the inclusion of other components, such as particulate fillers.

The dilatant may be combined with other components in addition to the components providing the dilatancy, e.g. fillers, plasticisers, colourants, lubricants and thinners. The fillers may be particulate (including microspheres or microballoons), or fibrous, or a mixture of particulate and fibrous. One class of particular preferred dilatants based on PBDMS comprises the borated silicone-based materials that are marketed under the generic name of silicone bouncing putties and are produced by various manufacturers. These include those by Dow Corning under product catalogue number 3179 and by Wacker GmbH under product numbers M48 and M29. Other companies such as Rhodia, GE Plastics, and ICI have also produced these materials, and other polymer-based dilatant materials having similar dilatancy characteristics, e.g. a similar modulus at low rates of strain and a similar plot of modulus with respect to the applied strain rate.

Particularly suitable materials for forming the helmet liner according to the present disclosure are disclosed in WO 03/055339 and WO 2005/000966.

The composite material described above may be comminuted for ease of handling or for moulding purposes.

Foamed composite materials which may be used for forming the helmet liner according to the present disclosure may be prepared by combining the polymer intended to comprise the first polymer-based material i); the polymeric dilatant intended to comprise the second polymer-based material ii); and a gas, vapour, supercritical liquid, or precursor thereof, such that the dilatant and the gas or vapour are distributed, generally substantially uniformly, throughout the matrix to produce a resiliently compressible material which exhibits a resistive load under deformation which increases with the rate of deformation. One suitable method comprises incorporating a polymer-based dilatant into a foamed synthetic elastomer, preferably during the formation of the foam.

An alternative method may comprise incorporating an unfoamed mixture of the first polymer-based material i) and the second polymer-based material ii) in the barrel of an injection moulding machine including means for supplying a pneumatagen thereto; bringing the mixture to an elevated temperature and an elevated pressure such that it is in molten form; supplying a pneumatagen to the barrel; and reducing the pressure of the heated composite material, thereby causing foaming of the composite material. The pressure may be reduced in this process by injecting the composite material into a mould or extruding the composite material, suitably at ambient pressure. Such a process may be operated on a continuous basis. Preferably, the elevated temperature is from 150° C. to 240° C., more preferably from 170° C. to 210° C. Preferably the elevated pressure at which the pneumatagen is injected is from 1600 psi to 2000 psi, more preferably from 1700 psi to 1900 psi.

A helmet liner comprising the composite according to one embodiment of the present disclosure may also be formed in a mould. For example, a precursor mixture suitable for forming the body may be incorporated in a first mould section, which may then be closed, for example by disposing a second mould section over the precursor mixture, and the precursor mixture may be cured and/or foamed to form the body. By a precursor mixture suitable for forming the body is meant any mixture of components, preferably a molten or semi-molten mixture, that may be cured or foamed, for example a molten or semi-molten mixture of the first polymer-based material i) and second polymer-based material ii), and optionally an activating/curing component. Curing of the precursor mixture may be caused by application of suitable pressures or temperatures, and/or by the use of one or more activating components. Foaming may be caused by introduction of a pneumatagen, for example a very high pressure gas such as nitrogen, or the use of microspheres comprising a plastic shell which hermetically encapsulate a gas or vapour; and causing the gas or vapour to expand to foam the precursor mixture. The temperatures used in such processes may preferably range from 150° C. to 240° C., more preferably from 170° C. to 200° C. or 190° C. to 210° C. The elevated pressures may preferably range from 5000 psi to 12000 psi, for example from 6000 psi to 7000 psi or from 9000 psi to 11000 psi.

Other moulding techniques for preparing the helmet liner according to the present disclosure are well known to the person of skill in the art, as are methods for temporarily or permanently, attaching the liner to the inside surface of a helmet.

Some embodiments of the disclosure will now be discussed, by way of example only, with reference to the accompanying drawings, in which.

Figures 1A, 1B, 1C, 1D, 1E:
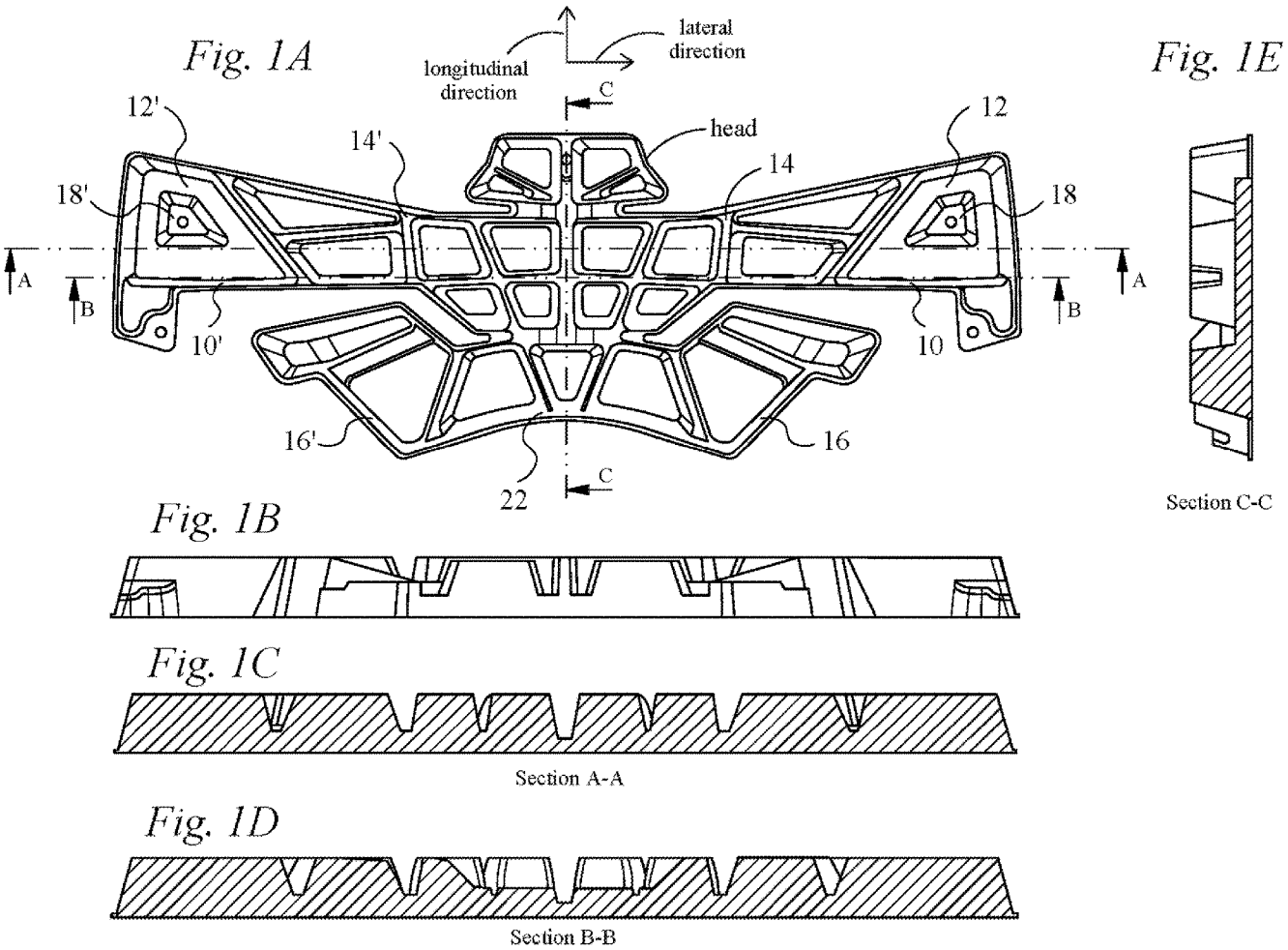
FIG. 1A shows a plan view of a helmet liner.
FIG. 1B shows an end view of the helmet liner in FIG. 1A.
FIG. 1C shows a side view of the helmet liner in FIG. 1A through the lateral line A-A across the liner.
FIG. 1D shows a side view of the helmet liner in FIG. 1A through a lateral line B-B across the liner.
FIG. 1E shows a side view of the helmet liner in FIG. 1A across a longitudinal line C-C of the liner.
Figure 2:
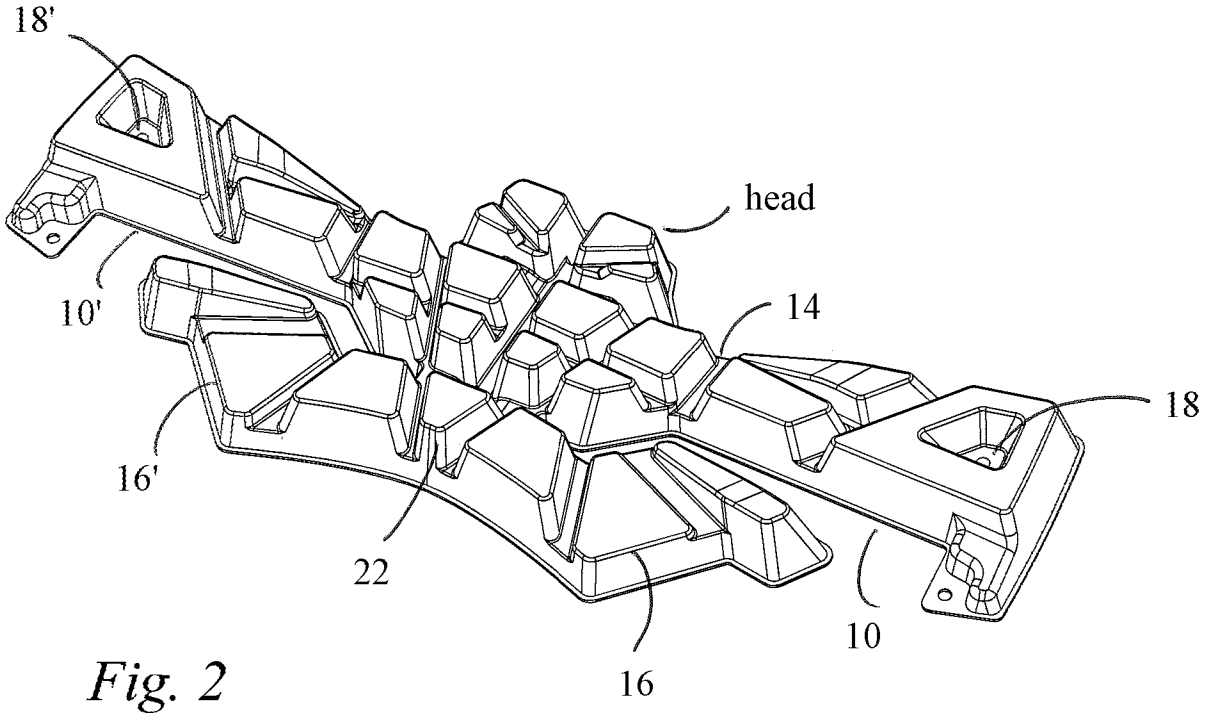
FIG. 2 shows a perspective view of the helmet liner of FIG. 1A.
Figure 3B:
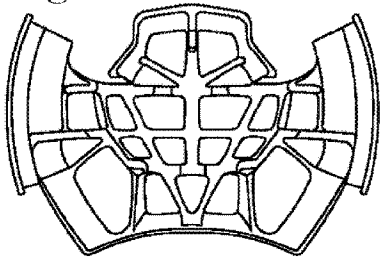
Figure 3C:
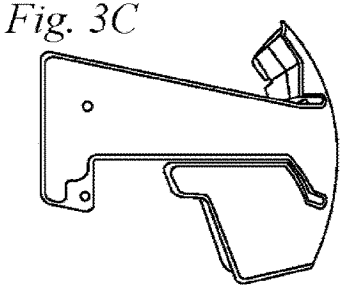
Figure 3D:
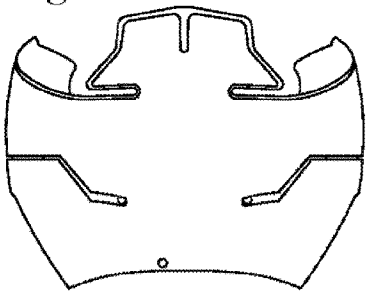
Figure 3A:
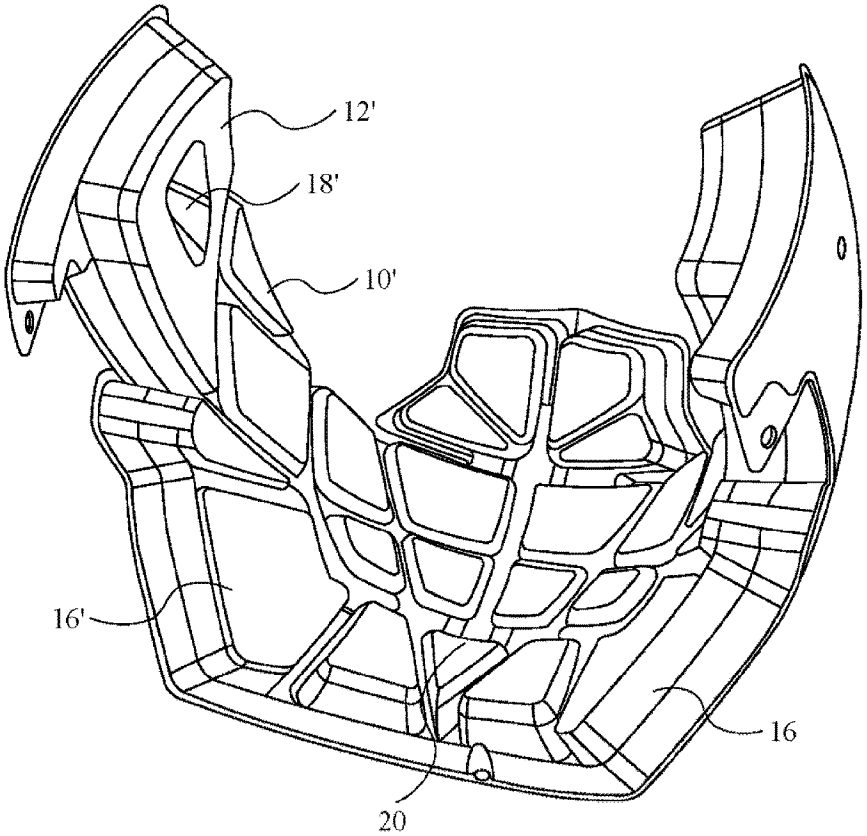

FIG. 3A, FIG. 3B, FIG. 3C, and FIG. 3D show the helmet liner of FIG. 1A and FIG. 2 coupled to a shell in elevation, front, side and rear views.

In the drawings, like reference numerals are used to indicate like elements.

The inventors in the present case have identified a number of particularly useful configurations of a helmet liner.

FIG. 1A shows a helmet liner adapted to protect a rear part of a wearer's head, for example a part of the head between the crown and the nape of the neck.

FIG. 1A shows the liner in a relaxed configuration, in which the liner is arranged in a flat planar configuration. The helmet liner illustrated in FIG. 1A comprises a body 22 adapted to lie in a longitudinal direction spanning at least a part of the distance between the crown and the nape of the neck. As illustrated in FIG. 1A, coupled to the body 22 are two wings 10, 10' which extend laterally from each side of the body 22. The wings 10, 10' may be arranged symmetrically about a centre line C-C of the body 22.

In the present disclosure the lateral direction is intended to mean the direction from the rear of the head around towards the ears. Accordingly, the liner can be conformed to the shape of a wearer's head so that the body 22 lies along a part of the head between the crown and the nape of the neck (in a longitudinal direction), and the wings 10, 10' extend in use laterally around the sides of the head toward the wearers ears.

As shown in FIG. 1A, the lateral extent of each wing 10, 10' is greater than its longitudinal extent, and the wings 10, 10' may be tapered so that the longitudinal extent of each wing 10, 10' may be greater towards the tips of the wings 10, 10' (e.g. portions of the wing 10, 10' that are laterally separated from the body 22 portion).

In a portion of the wings 10, 10' adjacent to the body 22, the tapering of the wings 10, 10' may be reversed. As shown in FIG. 1, a portion of the wing 10, 10' adjacent to the body 22 is greater in longitudinal extent than the rest of the wing 10, 10'. The wing 10, 10' then tapers to a smaller longitudinal extent at a midriff 14, before tapering out towards the tip of the wing 10, 10'.

The wings 10, 10' carry, towards the tip of each wing 10, 10', a pillar 12, 12' which encloses a space corresponding to pocket 18, 18'. In an alternative embodiment (not shown), pillar 12 may be replaced by at least two pillars of whose lateral extent is greater than their longitudinal extent arranged so that a lateral groove present between the at least two pillars comprises a pocket 18, 18' that is wider than the remainder of the groove. In the same alternative embodiment, one of the lateral edges of the at least two pillars carried by each wing 10, 10' may be joined together to partially enclose this pocket.

As illustrated in FIG. 1A, the liner may comprise two legs 16, 16' which extend from laterally from each side of the body 22 spaced from the wings 10, 10'. The legs 16, 16' may also be symmetrical about the centre line C-C of the body 22. The space between the wing 10, 10' and the leg 16, 16' may be a dog-leg 16, 16' shape that is narrower adjacent to the body 22 than towards the end of the leg 16, 16'.

The liner illustrated in FIG. 1A comprises a plurality of elongate grooves of varying depth which run across the surface of the liner that, in use, is to be presented towards the head of a wearer. The grooves subdivide the material of the liner into a plurality of pillars.

The grooves comprise a first plurality of longitudinal grooves configured to extend in use along a longitudinal direction aligned generally in the direction between the nape of a wearer's neck and the crown of the wearer's head. The longitudinal grooves may be aligned at an acute angle to the longitudinal direction, for example they may be aligned at an angle of less than 45° to the longitudinal direction, for example they may be aligned at an angle of less than 30° to the longitudinal direction, some of the longitudinal grooves may be parallel to the longitudinal direction.

The grooves comprise a second plurality of lateral grooves configured to extend in use at least partially around the head of the wearer in a lateral direction between the wearer's ears. The lateral grooves may be aligned at an acute angle to the lateral direction, for example they may be aligned at an angle of less than 45° to the lateral direction, for example they may be aligned at an angle of less than 30° to the lateral direction, some of the lateral grooves may be parallel to the lateral direction. At least one of the longitudinal grooves may be deeper than at least one of the lateral grooves.

FIG. 1B shows an end view of the helmet liner shown in FIG. 1A. As can be seen in FIG. 1B, the grooves in the liner subdivide the liner into pillars, coupled together by a base. The thickness of the liner (height of the pillars plus base) is even across the majority of the liner, although the top surface of some of the pillars may be inclined with respect to the top surface of at least one adjacent pillar. The depth of the grooves defines the thickness of the base, and correspondingly may also be considered to define the "height" of the pillars.

When the liner is conformed to a helmet, the base is adapted to lie toward the helmet so that the pillars extend in use from the base towards the head of a wearer. The pillars may be substantially trapezoidal in cross section.

In an embodiment each pillar is tapered from the base in towards an end, carrying an end surface adapted to face the head of the wearer, and the tapering of the pillars may be selected according to the curvature of the helmet so that when the base is conformed to the helmet, the end of each pillar is not pressed against an adjacent pillar.

FIG. 3 shows an example of a helmet liner conformed to a helmet shell. As illustrated in FIG. 3, the pillars extend from the base so the spacing of a pillar's end surface from its base is greater than at least one of the lateral and longitudinal extent of the pillar. FIG. 3 shows that the spacing between the pillars may be selected based on the curvature of the helmet shell, and the length of the pillars so that when the base is conformed to the helmet, voids remain between the pillars.

Advantageously, at least one of the voids may be prism shaped and comprise at least one trapezoidal face. As a result, at least one of the voids may be frustum shaped, being open topped and broader toward its base than towards the end surface of the pillar.

Referring now in more detail to the embodiment shown in FIG. 3 the helmet liner comprised a plurality of pillars, coupled together by a flexible base conformed to an inner surface of a helmet shell. As can be seen in FIG. 3, in this configuration, the base lies toward the helmet shell, and the pillars extend in use from the base towards the head of a wearer. Each pillar may be tapered from the base in towards its end. The end of each pillar may carry an end surface adapted to face the head of the wearer.

The pillars can extend from the base so the spacing of their end surfaces from the base is greater than at least one of the lateral and longitudinal extent of the pillar. In the embodiment illustrated in FIG. 3, the spacing between the pillars is selected based on the curvature of the helmet and the length of the pillars so that when the base is conformed to the helmet frustum shaped voids remain between the pillars. As will be appreciated, these voids may correspond to the lateral and longitudinal grooves discussed above with reference to FIG. 1A and FIG. 1B.

As illustrated in FIG. 3 when the base is conformed to the helmet, the end surfaces of the pillars may present a continuous support surface to the head of the wearer. The continuous support surface comprises at least one gap to permit air to flow from the surface into at least one of the voids between the pillars. The end surfaces of the pillars may comprise recesses.

As will be appreciated by the skilled reader in the context of the present disclosure, each of the examples described herein may be implemented in a variety of different ways. Any feature of any aspects of the disclosure may be combined with any of the other aspects of the disclosure. For example method aspects may be combined with apparatus aspects, and features described with reference to the operation of particular elements of apparatus may be provided in methods which do not use those particular types of apparatus. In addition, each of the features of each of the embodiments is intended to be separable from the features which it is described in combination with, unless it is expressly stated that some other feature is essential to its operation. Each of these separable features may of course be combined with any of the other features of the embodiment in which it is described, or with any of the other features or combination of features of any of the other embodiments described herein.

Aspects of the disclosure are set out in the following numbered clauses:

C1. A helmet liner adapted to be conformed to an inner surface of a helmet to cushion in use the rear of a wearer's head from the helmet, the liner comprising a plurality of elongate grooves comprising at least one longitudinal groove configured to extend in use along a longitudinal direction between the nape of a wearer's neck and the crown of the wearer's head, and at least one lateral groove adapted to extend in use at least partially around the head of the wearer in a lateral direction between the wearer's ears;

wherein the at least one longitudinal groove is deeper than the at least one lateral groove.

C2. The helmet liner of c1 wherein the grooves define pillars, coupled together by a base adapted to lie toward the helmet so that the pillars extend in use from the base towards the head of a wearer, wherein each pillar is tapered from the base in towards an end, carrying an end surface adapted to face the head of the wearer, and the tapering of the pillars is selected according to the curvature of the helmet so that when the base is conformed to the helmet, the end of each pillar is not pressed against an adjacent pillar.

C3. The helmet liner of c2 wherein the pillars extend from the base so the spacing of the end surface from the base is greater than at least one of the lateral and longitudinal extent of the pillar.

C4. The helmet liner of c2 or c3 wherein the liner is adapted to relax into a flat planar configuration.

C5. The helmet liner of c4 further comprising:

at least two wings adapted to extend in the plane of the flat planar configuration when the liner is relaxed, and to extend in use laterally around the sides of the head of a wearer towards the wearer's ears when the base is conformed to the helmet.

C6. The helmet liner of c5 wherein the lateral extent of each wing is greater than its longitudinal extent.

C7. The helmet liner of c6 wherein the wings are coupled to extend laterally from a body portion, and longitudinal extent of each wing is greater towards portions of the wing that are laterally separated from the body portion.

C8. The helmet liner of any of c2 to c7 in which the spacing between the pillars is selected based on the curvature of the helmet and the length of the pillars so that when the base is conformed to the helmet, voids remain between the pillars.

C9. The helmet liner of c8 wherein at least one of the voids is prism shaped and comprises at least one trapezoidal face.

C10. The helmet liner of c8 or c9 in which at least one of the voids is frustum shaped.

C11. A helmet liner comprising a plurality of pillars, coupled together by a flexible base adapted to be conformed to an inner surface of a helmet so the base lies toward the helmet and the pillars extend in use from the base towards the head of a wearer, wherein each pillar is tapered from the base in towards an end, carrying an end surface adapted to face the head of the wearer, wherein the pillars extend from the base so the spacing of the end surface from the base is greater than at least one of the lateral and longitudinal extent of the pillar and the spacing between the pillars is selected based on the curvature of the helmet and the length of the pillars so that when the base is conformed to the helmet frustum shaped voids remain between the pillars.

C12. The helmet liner of c11 wherein the voids comprise at least one longitudinal groove configured to extend in use along a longitudinal direction between the nape of a wearer's neck and the crown of the wearer's head, and at least one lateral groove adapted to extend in use at least partially around the head of the wearer in a lateral direction between the wearer's ears;

wherein the at least one longitudinal groove is deeper than the at least one lateral groove.

C13. The helmet liner of any of c2 to c12 in which the spacing between the pillars is selected based on the curvature of the helmet, the length of the pillars, and the area of the end surfaces so that when the base is conformed to the helmet, the end surfaces of the pillars present a continuous support surface to the head of the wearer.

C14. The helmet liner of c13 in which the continuous support surface comprises at least one gap to permit air to flow from the surface into at least one of the voids between the pillars.

C15. The helmet liner of any of c2 to c14 in which the end surfaces of the pillars comprise recesses.

C16. The helmet liner of any of c10 to c15 in which the base is adapted to relax into a flat planar configuration.

C17. The helmet liner of c15 or c16 in which the base comprises a body portion, and at least two wings, adapted to extend laterally from the body portion in the plane of the flat planar configuration when the base is relaxed.

C18. The helmet liner of c17 in which the base comprises at least two legs coupled to the body, wherein the legs are shorter than the wings and are adapted to extend laterally from the body in the plane of the flat planar configuration when the base is relaxed.

C19. The helmet liner of any of c1 to c18 which comprises a rate-sensitive material.

C20. The helmet liner of c19, wherein the rate-sensitive material comprises a microcellular polyurethane foam.

C21. The helmet liner of c19, wherein the rate-sensitive material comprises a composite material comprising i) a first polymer-based material and ii) a second polymer-based material, different from i), which exhibits dilatancy in the absence of i), wherein the second polymer-based material ii) is entrapped in a matrix of the first polymer-based material i), the composite material being unfoamed or foamed, and, when unfoamed being preparable by incorporating the second polymer-based material ii) with the first polymer-based material i) prior to formation of the matrix, or, when foamed, being preparable by incorporating the second polymer-based material ii) with the first polymer-based material i) prior to foaming.

C22. A kit comprising a plurality of helmet liners according to any of c4 to c21, or any preceding clause as dependent upon c4 stacked together so that the bases are parallel.

C23. A helmet comprising a helmet liner according to any of c1 to c21.

C24. The helmet according to c23 which is an American football helmet.

The invention claimed is:

1. A helmet liner adapted to be conformed to an inner surface of a helmet to cushion in use the rear of a wearer's head from the helmet, the liner comprising a plurality of elongate grooves comprising at least one longitudinal groove configured to extend in use along a longitudinal direction between the nape of a wearer's neck and the crown of the wearer's head, and at least one lateral groove adapted to extend in use at least partially around the head of the wearer in a lateral direction between the wearer's ears;

wherein the at least one longitudinal groove is deeper than the at least one lateral groove;

wherein at least one of the longitudinal grooves or lateral grooves define two or more pillars, coupled together by a base adapted to lie toward the helmet so that the pillars extend in use from the base towards the head of a wearer; and wherein each pillar is tapered from the base in towards an end, carrying an end surface adapted to face the head of the wearer, and the tapering of each pillar is selected according to the curvature of the helmet so that when the base is conformed to the helmet, the end of each pillar is not pressed against another pillar, and the spacing between the two or more pillars is selected based on the curvature of the helmet and the length of the two or more pillars so that when the base is conformed to the helmet, voids remain between the two or more pillars, wherein at least one of the voids is frustum shaped.

2. The helmet liner of claim 1 wherein each pillar extends from the base so the spacing of the end surface from the base is greater than at least one of the lateral and longitudinal extent of each pillar.

3. The helmet liner of claim 1 wherein the liner is adapted to relax into a flat planar configuration.

4. The helmet liner of claim 3 further comprising:

at least two wings adapted to extend in the plane of the flat planar configuration when the liner is relaxed, and to extend in use laterally around the sides of the head of a wearer towards the wearer's ears when the base is conformed to the helmet.

5. The helmet liner of claim 4 wherein the lateral extent of each wing is greater than its longitudinal extent.

6. The helmet liner of claim 1 in which the end surface of each pillar comprises recesses.

7. The helmet liner of claim 6 in which the base comprises a body portion, and at least two wings, adapted to extend laterally from the body portion in the plane of the flat planar configuration when the base is relaxed.

8. The helmet liner of claim 7 in which the base comprises at least two legs coupled to the body, wherein the legs are shorter than the wings and are adapted to extend laterally from the body in the plane of the flat planar configuration when the base is relaxed.

9. The helmet liner of claim 1 which comprises a rate-sensitive material.

10. The helmet liner of claim 9, wherein the rate-sensitive material comprises a microcellular polyurethane foam.

11. The helmet liner of claim 9, wherein the rate-sensitive material comprises a composite material comprising i) a first polymer-based material and ii) a second polymer-based material, different from i), which exhibits dilatancy in the absence of i), wherein the second polymer-based material ii) is entrapped in a matrix of the first polymer-based material i), the composite material being unfoamed or foamed, and, when unfoamed being preparable by incorporating the second polymer-based material ii) with the first polymer-based material i) prior to formation of the matrix, or, when foamed, being preparable by incorporating the second polymer-based material ii) with the first polymer-based material i) prior to foaming.

12. A kit comprising a plurality of helmet liners according to claim 3 stacked together so that the bases are parallel.

13. A helmet comprising a helmet liner according to claim 1.

14. The helmet according to claim 13 which is an American football helmet.

* * * * *